United States Patent [19]

Tiitola

[11] Patent Number: 4,595,215

[45] Date of Patent: Jun. 17, 1986

[54] COATING MATERIAL AND COATING FOR A SKI, FOR VARIABLE SNOW CONDITIONS, AND METHOD OF MANUFACTURE OF SAME

[75] Inventor: Antti-Jussi Tiitola, Tampere, Finland

[73] Assignee: Karhu-Titan Oy, Finland

[21] Appl. No.: 466,888

[22] Filed: Feb. 16, 1983

[30] Foreign Application Priority Data

Feb. 19, 1982 [FI] Finland ..... 820552

[51] Int. Cl.[4] ..... A63C 5/04

[52] U.S. Cl. ..... 280/604; 280/610

[58] Field of Search ..... 280/604, 610

[56] References Cited

U.S. PATENT DOCUMENTS

| | | | |
|---|---|---|---|
| 2,287,252 | 6/1942 | Kaufmann | 280/604 |
| 3,918,728 | 11/1975 | Stugger et al. | 280/610 X |
| 4,272,577 | 6/1981 | Tyng | 280/604 X |
| 4,382,610 | 5/1983 | Arnsteiner | 280/610 |
| 4,431,209 | 2/1984 | Völkl et al. | 280/604 |

FOREIGN PATENT DOCUMENTS

| | | | |
|---|---|---|---|
| 1120965 | 3/1982 | Canada | 280/604 |
| 2621490 | 12/1977 | Fed. Rep. of Germany | 280/604 |
| 3039898 | 5/1982 | Fed. Rep. of Germany | 280/604 |
| 179791 | 12/1935 | Switzerland | 280/604 |
| 641683 | 3/1984 | Switzerland | 280/604 |

*Primary Examiner*—George F. Lesmes
*Assistant Examiner*—Nancy A. B. Swisher
*Attorney, Agent, or Firm*—Steinberg & Raskin

[57] ABSTRACT

A running surface or coating material, or coating for a ski, for variable snow conditions, in particular for use in cross-country or long distance skiing, is mounted in the central region of the running surface of the ski as an ascending aid. The coating consists of a soft elastically behaving substance and a harder particle component. Part of the harder particles are so disposed that they project from the bottom surface of the ski. This is accomplished by grinding the surface of the ski bottom coating plate means to be the bottom surface, in such manner that a hairy cover is produced on the ground surface. The projecting particles of the hairy cover are affixed by their roots in the elastically behaving substance.

14 Claims, 12 Drawing Figures

FIG. 1A
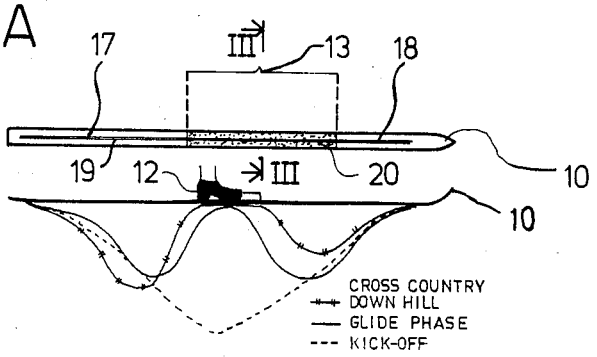
FIG. 1B
FIG. 2A
FIG. 2B
FIG. 2C
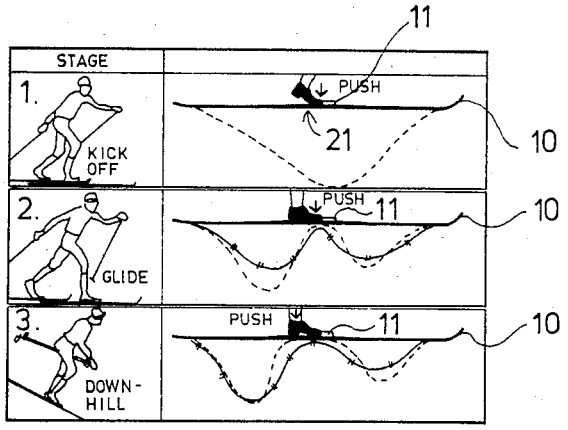
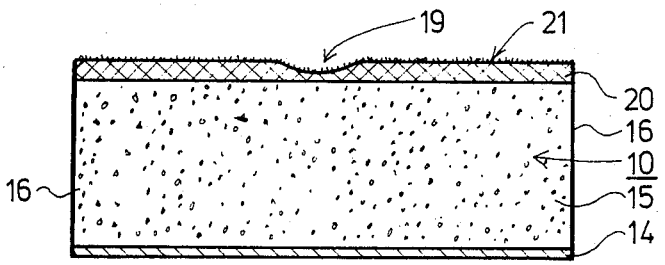
FIG. 3

COATING MATERIAL AND COATING FOR A SKI, FOR VARIABLE SNOW CONDITIONS, AND METHOD OF MANUFACTURE OF SAME

BACKGROUND OF THE INVENTION

The present invention relates to a coating for a ski for variable snow conditions. More particularly, the invention relates to a coating for a ski to be used in cross-country or long distance skiing and to a method of manufacturing same.

The invention further relates to a ski for variable snow conditions, in particular to a cross-country or long distance ski, of which the bottom gliding surfaces are coated with polyethylene or another material having a low enough coefficient of gliding friction and where the central area of the sliding bottom coming into contact with the snow during the push-off phase, coated with a material having elastic behavior, is formed to constitute a holding bottom, or adhesion coating.

The proper functioning of a ski intended for cross-country or long distance skiing, that is, the adhesion and gliding functions, depends on the fact that the adhesive friction, or the friction at rest between the ski's bottom surface and the snow, is high and the gliding friction, or the friction of motion, is low. If this condition is satisfied, it is possible to push off well and to glide well with the ski. On the other hand, the snow contributes substantially to the creation of favorable friction properties with regard to the holding and gliding capacity of the ski. The condition of snow changes with changes of temperature and with the age of the snow crystal. It has therefore been necessary, as is well-known, to wax cross-country or long distance skis. One had to spread over the bottom surface of the ski a layer of a certain wax-like substance which was appropriate to the purpose of obtaining desired friction characteristics for the snow existing and in the conditions prevailing in each instance.

The adhesive friction or the friction at rest between snow and ski, that is the holding capacity, is dependent in the first place on the crystal form of the snow. It is known that the crystal form of snow changes in dependence upon the age of the snow crystal, the snow temperature and the moisture content. The snow crystal has numerous different forms, but essentially it is in this connection the sharpness of the crystal points. New snow that has fallen in sub-zero weather has very sharp points and a fine distribution. With increasing age of the snow, the crystals grow together, whereby their points are blunted.

When the temperature rises close to zero degrees C, the moisture content of the snow increases, and simultaneously the sharp points of the crystals melt. Due to the influence of the moisture, the inner friction of the snow increases and the crystals adhere easily to each other, and also to surfaces which absorb the water.

It is possible in the case of frost snow, which has sharp points, to achieve sufficient adhesive friction with an elastically behaving material with suitable hardness, into which the sharp points of the snow crystals can enter. Known materials of this kind are, for example, polyurethane elastomer, rubber, or the equivalent. The functioning range is favorably widened by selection of an elastomer with a hardness which is as strongly temperature-dependent as possible.

On transition to temperatures above the freezing point, the pre-conditions for creation of adhesive friction change, because the water present on the surface of the snow crystals forms a film on the ski's running surface. This influence prevents direct contact of the crystals with the bottom material; the water film acting as a friction-reducing lubricant in this connection.

It is possible by successful waxing to achieve both good gliding and good holding capacity of the ski. However, selection of appropriate waxes for different snow conditions and the waxing process require profound professional skill and experience, and it is a fact that in many instances even specialists fail in the art of waxing.

It is possible, on the other hand, for snow conditions to change very rapidly, so that the adhesion and/or gliding capacity may, for example, be substantially impaired during one competition. It is also a drawback of waxed ski running surfaces that the waxing agents are consumed very rapidly in certain circumstances.

It would thus be a decisive advance if a ski bottom surface or a ski coating could be created which possesses good gliding properties as well as good holding or adhesion properties in varying snow conditions.

As known, the function of ski waxes is based on the circumstance that the sharp points of the snow crystals penetrate into the elastic or plastic superficial layer formed by the waxing agents and thereby produce a high enough friction at rest or adhesive friction to provide the ski with its holding capacity. The gliding of the ski occurs, in the case of waxed as well as unwaxed skis, upon a thin water film due to the fact that the points of the snow crystals melt under the influence of the friction of motion.

Various ski bottom or ski coating embodiments known in the art consist of active and passive parts, which penetrate into the snow and produce a mechanical holding action. In this regard, a ski coating known in the art has a surface profiled in fish-scale fashion. The scales form inclined planes along which the ski glides. The rearwardly oriented vertical steps of the scales prevent backward gliding and produce holding properties due to the banking up of the snow in front of them.

A recessed and stepped bottom or coating is also known in the art. The functioning of such bottom is based on the same mechanism as that of the scaled coating, with a negative profile, however. This bottom displays better gliding behavior, whereas its holding or adhesion capacity is poorer than that of the scaled coating. Norwegian publicizing print No. 89238 is an example of this solution to the problem.

Various hairy ski bottoms or coatings are also known in the art. This coating, such as, for example, synthetic hair strips, is applied to the bottom. The hairs are disposed with an inclination in the direction of gliding. In these bottoms, movement directed against the hairs causes the holding or adhesion of the ski in the push-off process. German publicizing print No. 1 144 165 and Finnish Pat. No. 43401 are examples of these known bottoms.

Also known in the art are ski bottoms or coatings or running surfaces of slick plastics, for example, Teflon, having a characteristically minimal friction coefficient. U.S. Pat. No. 2,908,506 is an example of such bottoms. In these skis, however, the holding problem is not solved.

Furthermore, various ski embodiments are known in the art in which an effort has been made to improve the inherently poor adhesion capacity towards wax agents which many plastic coatings display. An example of this is disclosed in U.S. Pat. No. 3,897,074, which is equivalent to Finnish Pat. No. 43401. As disclosed in these patents, it is known in the art to carry out the surface treatment of the bottom or running surface by grinding to produce a nap-like surface on the ski bottom. This provides the gliding capacity of the ski.

It is typical of all the previously known mechanical ski bottom structures hereinbefore mentioned that they function relatively well within a relatively narrow range of limited snow conditions, but that they are nearly unusable in conditions other than those of the narrow range. Thus, for example, the scaled bottom operates very well on both wet snow and soft new snow, but it is unable to satisfactorily prevent the backward slipping of the ski on a glazed sub-base. The functioning of the scaled bottom is further impaired by its rapid wear, since the holding of the surface of the ski bottom is only effective if the rear edges of the scales are sharp. The other embodiments hereinbefore discussed also have certain drawbacks in each case. Thus, they have not become popular with skiers.

Regarding the state of art, particular reference is made to Finnish Pat. No. 43401 of the same applicant. As therein disclosed, a textile fabric is used for the ski bottom material. The fibers of the fabric extend at least up to the boundary surface of the gliding surface of the ski bottom. In this solution of the problem, the principal object is to achieve good adhesion of the ski wax compounds to the gliding bottom via the fibers. However, certain drawbacks are also apparent in this gliding bottom. One drawback is that the manufacture of the gliding bottom is difficult. Another drawback is that the fibers wear down and break rapidly.

SUMMARY OF THE INVENTION

The principal object of the invention is to provide a ski bottom or coating having good holding or adhesion properties as well as good gliding properties, even with variable snow conditions.

Another object of the invention is to provide a simple procedure for the manufacture of such a coating.

The coating of the invention, and the method of manufacture of the invention may in particular be applied to a ski having merely in the central area of its running surface, an adhesion coating, but otherwise having bottom surfaces with a very low coefficient of gliding friction.

The ski coating of the invention has a coating material which consists of at least two components with different mechanical functions. One component of the coating constitutes a soft, elastic matrix. The viscoelasticity of this component is so selected that the snow crystals or ice granules are enabled, in the case of cold snow, on powdery snow, or equally on coarse crystalline, icy snow, to penetrate the soft component, which is elastic, in order to insure a sufficiently durable tooth engagement between the ski coating and the base. The second component of the coating is required to carry ever more efficiently with increasingly wet snow. The water film occurring or created between the ski and the base when the snow is wet, and which then acts as a type of lubricant, is pierced by the particles projecting from the soft coating component of the ski coating material. The particles are sufficiently hard and/or rigid to press through the water film into the snow. In this manner, even under these conditions, a high degree of adhesive friction between ski and base is realized, because the snow itself has very great strength in this case and the few hard particle points in the ski coating maintain a good grip between the snow crystals. The ski coating of the invention therefore operates and functions with extremely high efficiency under all and any snow conditions.

The particles constituting the additional coating component may have various shapes, and it is possible to utilize fibers, spherical bodies, granule-resembling bodies or crystals. It is important in this connection that they are formed so that they project from the finished, for example, fully machined, ski coating in the form of rigid points, granules or fibers. This is accomplished, for example, by so adjusting the particle materials to the material of the soft, elastically behaving coating component that good mutual anchoring of the coating components is guaranteed. When the underside, or running surfaces of the ski coating of the invention is subsequently machined, this implies in the first place, or principally, removal of the softer coating component. Then the particles in the coating material, in connection with this process, form the rigid points or equivalent bodies projecting from the ski coating, while they will remain firmly anchored in the soft, elastically behaving coating component.

A preferred further embodiment of the ski coating of the invention is accomplished by mixing fibers into the coating material. The fibers are induced by grinding, or by an equivalent machining procedure, to project from the coating/running surface. These fibers produce a hairy surface in the central part of the running surface of the ski. The favorable properties of the hairy surface are based on the circumstances that the free ends of the fibers destroy the water film formed of the water in the upper snow crystal surface under the running surface of the ski. This results in the crystal being brought into direct contact with the elastically behaving coating material of the ski. This produces adequate friction at rest in view of the adhesion or holding capacity of the ski.

Points projecting from the gliding surface of the ski may also be produced in an advantageous manner when the particles have been formed rod-like or granular.

The soft, elastically behaving substance of the coating consists to advantage of at least one elastomer. A suitable india rubber mixture, modified epoxy resin, polyvinylchloride (PVC) or similar elastomers, or a mixture of several such elastomers, are utilized as the coating component consisting of elastomers, preferably polyurethane. The hardness of the coating component formed by the elastomer or by the elastomer mixture is selected so that it increases relatively steeply with decreasing temperature. This has a highly advantageous effect on the optimization of the gliding properties, since the snow crystals similarly become harder and more pointed at lower temperatures.

BRIEF DESCRIPTION OF THE DRAWINGS

For a fuller understanding of the invention, reference is had to the following description, taken in connection with the accompanying drawings, in which:

FIG. 1A is a view of a ski bottom or coating, from the underside;

FIG. 1B is a graphic presentation illustrating the differences of the surface pressure between the ski's gliding bottom and the snow at different phases of skiing;

FIGS. 2A, 2B and 2C are graphic presentations illustrating the different phases of skiing and the differences in surface pressure between the gliding bottom and snow in these phases;

FIG. 3 is a cross-sectional view on an enlarged scale, taken along the lines III—III, of FIG. 1A, of the gliding bottom of the ski of the invention;

DESCRIPTION OF PREFERRED EMBODIMENTS

Figure 4:
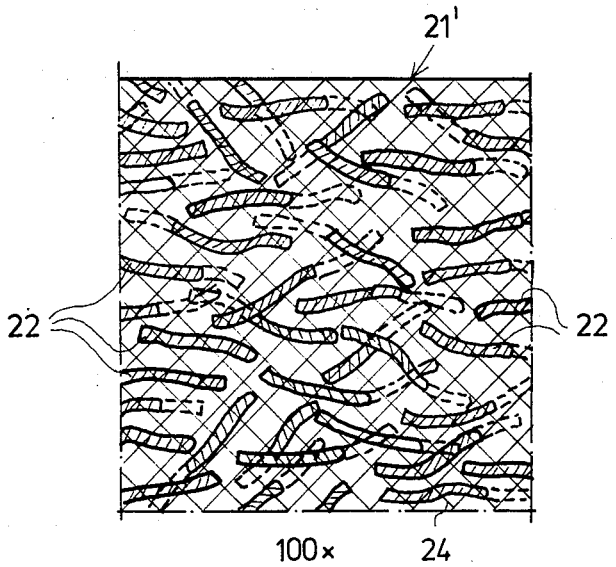
FIG. 4 is a cross-sectional view, magnified 100-fold, of an embodiment of the bottom material of the invention prior to the grinding treatment of the gliding bottom or glide running surface.

The basic principles of the functioning of the ski of the invention are described with reference to FIGS. 1 and 2. The functioning of a cross-country ski implies that a friction may be attained between the bottom 13, 17, 18 of the ski 10 and the snow. At rest, the friction is high enough for push-off. There is a low gliding friction between the bottom of the ski 10 and the snow while gliding. The object of modern ski manufacturing techniques is to satisfy the aforedescribed conditions by means of ski bottom material, ski waxing compounds and proper ski camber. The purpose of the bottom material, which frequently consists of polyethylene plastics at present, is to achieve low gliding friction between the ski and the snow. Polyethylene meets this requirement satisfactorily at all temperatures and for all types of snow structure.

The friction at rest required for push-off is normally provided by ski wax, which is selected in accordance with snow structure and temperature. It is commonly known that the action of waxes is based on the points of the snow crystals entering the wax layer, which displays plastic behavior, and thereby causing the friction which is needed in the push-off phase. Since the wax course is softer than the bottom itself, it also has the tendency to weaken the gliding of the ski, so that the skier must always seek a compromise between holding and gliding. It has been possible to considerably enhance the functioning of the wax by proper construction and prestressing or cambered shape of the ski in attempting to influence the surface pressure between ski and snow in different phases of diagonal gait skiing.

When the ski camber arc is selected to have a parabolic shape and the ski binding 11 is affixed at a point where the skier's push-off force is directed at the apex of the parabola, the surface pressure between ski and snow in diagonal gait skiing behaves as shown in FIGS. 2A, 2B and 2C, in connection with which the different phases are described in more detail.

In Phase 1, which is push-off, the skier's whole weight bears fully on the ball of the push-off leg 12. In addition to the pressing force, the push-off force produced by the musculature is effective. This force may be a 1.5 to 3-fold multiple of the pressing force. The surface pressure results from the total effect of these forces and is highest under the push-off point and diminishes rather steeply in both directions therefrom. This is shown by the dotted lines in FIGS. 1B and 2A.

In Phase 2, which is gliding, the skier's full weight rests entirely on the leg which is moving and is equally divided between heel and ball. The point of action of the force moves about ⅓ of the length of the foot from the preceding phase towards the rear end of the ski. The surface pressure between ski and snow changes substantially at the detachment of the parabola apex from the base and at the simultaneous distribution of the pressure between two apices, lying on either side of the leg 12. The curve representing the distribution of surface pressure, shown in a solid line in FIG. 1B, is equivalent to the cross-stroke curve of FIG. 2B. The dotted line curve of FIG. 2B represents, compared with the cross-stroke curve, the surface pressure when a more rigid ski, or a skier of less weight, is involved.

In Phase 3, which is downhill skiing, the skier's weight rests uniformly on both skis. The pressure is distributed as in Phase 2; each ski being burdened with only half the skier's weight. The curve indicated in FIG. 1B by Xs corresponds to the curve shown by dotted line in Phase 3 of FIG. 2C. The curve shown by Xs in FIG. 2C refers to a situation in which a ski with greater elasticity or a heavier skier is concerned.

The observation can be made on the basis of the foregoing that for the gliding of the ski, the gliding friction coefficient at the rear and forward parts 17, 18 of the gliding surface of the ski is important and for the holding, the friction coefficient at the central part 13 of the ski at rest is important.

FIG. 3 is a cross-sectional view, on an enlarged scale, of the ski of the invention. The ski 10 is a laminated plate structure and its carrying parts consist of a cover plate 14 and a bottom plate, and a hard foam core 15 therebetween. The hard foam core 15 has harder side portions 16 produced by die molding. As shown in FIGS. 1A and 3, the rear and forward parts 17 and 18 of the gliding bottom of the ski 10 are coated with polyethylene plastic or the equivalent, producing only gliding capacity. The central part 13 of the ski is coated with a bottom part 21 in accordance with the invention and produces holding capacity. In special instances, the gliding bottom of the ski may be coated with a bottom material plate 20 of the invention in its entirety. A running groove 19, known in the art, is provided in the bottom 17, 18, 20.

Two non-restrictive examples of the composition of the bottom plate material are described as follows:

EXAMPLE 1

20% by weight of polyamide fibers having a diameter of 10–20 microns and a length of 0.5–1.0 mm, and 80% by weight of polyurethane elastomer.

EXAMPLE 2

20% by weight of polyamide fibers having a diameter of 10–20 microns and a length of 0.5–1.0 mm, and 80% by weight of a rubber mixture, the basic elastomer consisting of nitrile rubber.

Figure 5:
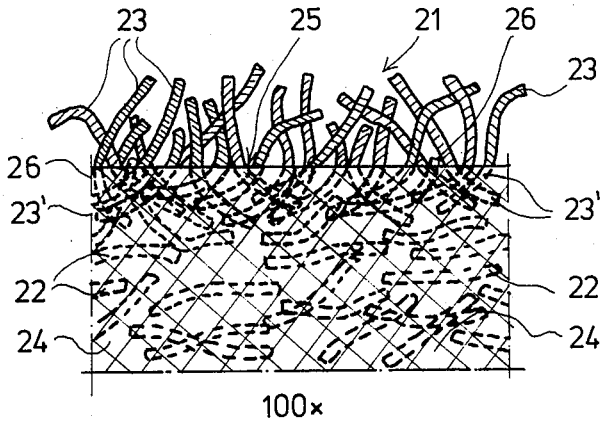
FIG. 5 is a sectional view, magnified 100-fold, of the embodiment of FIG. 4 of the gliding bottom of the ski of the invention upon having been so ground that it will function as desired in accordance with the invention.

When the bottom or coating material 20 of the invention is poured in the aforedescribed manner, a surface 21' is obtained from which fibers 22 do not project (FIG. 4). FIG. 4 is a 100-fold magnification of the bottom material 20, manufactured in accordance with Example 1. The elastomer component is indicated by reference numeral 24. As shown in FIG. 4, the surface 21' of the bottom material plate 20 is even. As taught by the invention, the surface 21' of the bottom material plate 20 is ground, either before molding the ski, or before said plate is affixed to the ski bottom, or after said bottom is affixed. The grinding is accomplished by a grinding wheel or on a band grinding machine of appropriate coarseness, or in an equivalent manner. In the grinding phase, some of the fibers 23 present in the elastomer component 24 become salient as free fibers 23, attached by their roots 23' to said elastomer component. This provides a hairy fiber surface 21 resembling that schematically shown in FIG. 5. Naturally, some of the fibers 26 at the surface 25 are completely severed or torn off.

When polyamide or equivalent fibers, strong and tough enough, are selected as the fiber material, a hair surface 21 is obtained which is sufficiently durable and dense for the purposes of the invention. The principal mode of action of the hair surface 21 is that the fibers 23 destroy the water film established on the bottom material of the ski. This results in contact of the snow crystals with the elastically behaving bottom material which is adequate for holding. Naturally, the fibers 23 become oriented, in a manner of speaking, with the grain in the direction of skiing, and said fibers may provide a mechanical holding effect to a certain extent.

Comparative tests have revealed that the most advantageous thickness of the fibers 22 is in a range of about 5 to 100 micrometers, preferably between 10 and 20 micrometers. The most favorable average length of the fibers 23 projecting from the ground surface 25 was found to be in a range between about 0.1 and 2 mm, prefefably between 0.5 and 1 mm. The expedient quantity of intact fibers remaining at the grinding phase on the surface 25 was found to be about 2 to 100 fibers per $mm^2$, preferably about 10 to 30 fibers per $mm^2$. Polyamide and/or other equivalent fibers 22 are utilized. These are of a type which become anchored in the elastomer component 24, tolerate the manufacturing temperatures of the bottom plate component and have adequate mechanical strength and toughness.

The material or material combination of the elastomer component 24 is so selected that the holding effect of the gliding bottom on the central part 13 of the ski is so based on the elasticity or the bottom part that the points of the snow crystals can at the push-off phase (FIG. 2A) penetrate deep enough into the surface plane of the bottom 21' that small depressions are produced in said bottom. The material for the elastomer component 24 is selected for the greatest advantage so that its hardness increases with decreasing temperature. A typical example is an elastic combination material bottom or coating having a hardness at −20° C. of about 50 Shore D and at 0° C. about 40 Shore D. The hardness decreases substantially linearly with increasing temperature within the temperature range, as is usually common in skiing.

Figure 6:
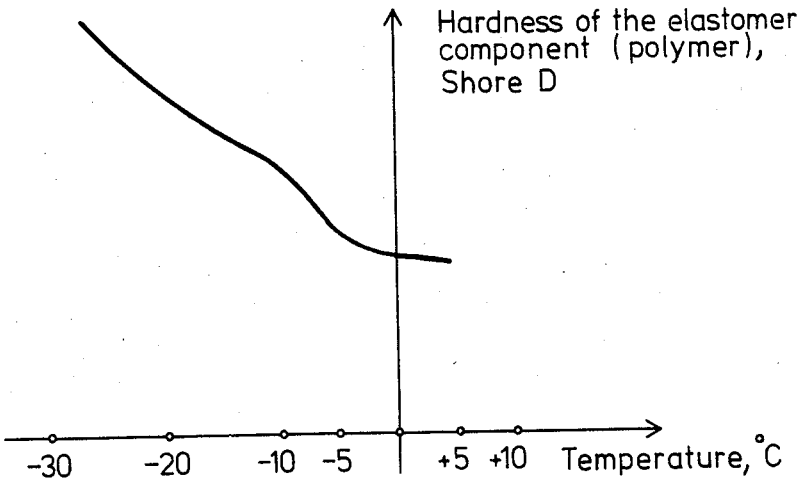
FIG. 6 is a graphical presentation illustrating the hardness of the elastomer component relative to temperature.

FIG. 6 shows the course of the elastomer component's hardness plotted against temperature. In FIG. 6, the abscissa represents the temperature in degrees C and the ordinate represents the hardness of the elastomer component in Shore D.

Figure 7:
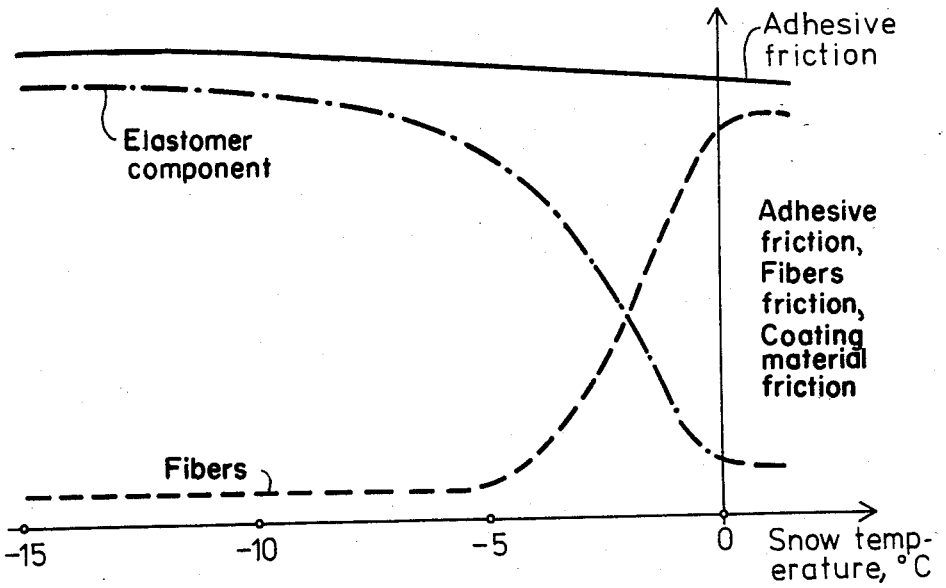
FIG. 7 is a graphical presentation of the adhesive friction, of the elastomer component, the fibers and the coating material in total relative to the temperature of the snow.

FIG. 7 illustrates the service behavior of the ski coating material or the ski coating of the invention within the entire operating temperature spectrum of the ski. In FIG. 7, the abscissa represents the temperature of the snow in degrees C and the ordinate represents the adhesive friction. In FIG. 7, the solid line represents the adhesive friction of the ski coating on the whole. Contributions to this total adhesive friction are supplied, on one hand, by the elastomer component illustrated by the dot-and-dash curve and, on the other hand, by the fibers illustrated by the dotted curve, so that the solid curve is obtained by superposition of the other two curves. As shown in FIG. 7, at low temperatures, due to the greater hardness of the elastomer component in that range, the fibers only contribute little to increasing the friction, but they become increasingly effective in the vicinity of the freezing point and in a way compensate for the decline of the elastomer component's adhesive friction curve by projecting ever more prominently from the continuously softening elastomer component. It is possible by this cooperation of the coating components to achieve, within the entire operating range of the ski, a substantially constant push-off adhesion or holding capacity of the coating.

At plus temperatures, or temperatures above freezing, the hairy surface 21 formed of fibers has a destructive effect, as described, on the water film. This provides the holding effect of the surface 25 based on elasticity. Of particular importance is the effect of the fibers 23 in relation to snow with a high water content. Sufficient holding effect would be reached at freezing temperatures by suitable elastomers, even without the fibers 23, but under watery snow conditions, the holding of the ski can be substantially improved by the gliding bottom 20 of the invention, ground to hairy condition.

Figure 8:
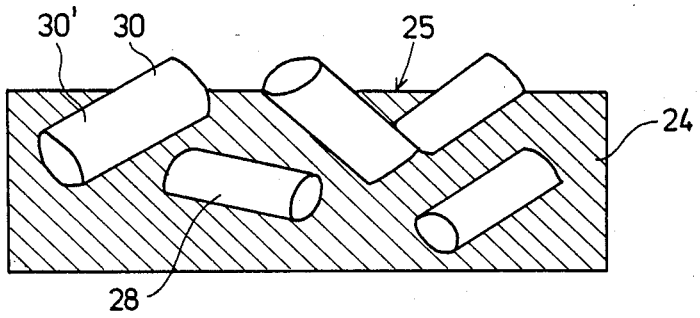
FIG. 8 is a sectional view, greatly magnified, of another embodiment of the gliding bottom of the ski of the invention.
Figure 9:
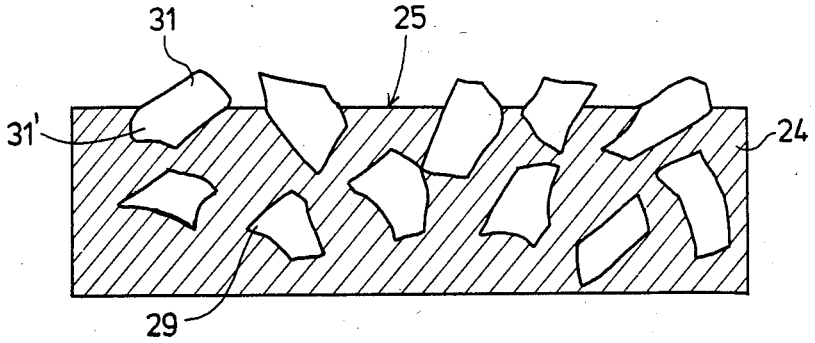
FIG. 9 is a sectional view, greatly magnified, of still another embodiment of the gliding bottom of the ski of the invention.

FIGS. 8 and 9 illustrate further embodiments of the ski coating of the invention. The embodiments of FIGS. 8 and 9 differ from the aforedescribed embodiment in that, in the embodiments of FIGS. 8 and 9, rod-shaped particles 28 or granular bodies 29 are embedded in the coating component 24 constituted by an elastomer, or elastomer mix, instead of fibers. The particles 28 and 29 constitute solid bodies. The coating, which consists of a soft coating component, or elastomer component, and a particle coating component, may also be cast in the shape of a plate. The coating plates are cut to shape and inserted in the central region of the running surface of the ski. The final machining of the adhesive coating is then carried out with the plate positioned on the ski. As a result of such machining, in the first place, the elastomer component is removed, so that sections 30 and 31 of the harder particles project from the coating surface 25. The particles 28 and 29 remain firmly anchored in the elastomer component 24 via their root sections 30' and 31', respectively.

The particles 28 and 29 may be subjected to deformation in the final machining treatment of the ski coating or the adhesive coating. The final treatment of the ski coating plate produces a hairy, or rough, cover surface 21 which is able to destroy the water film layer forming between the ski coating and the base when the snow becomes wetter.

The invention is not intended to be confined to the aforedescribed embodiments. Thus, for example, in a modification of the aforedescribed embodiments, the soft elastically behaving ski coating component may also consist of polyethylene, polyvinyl alcohol (PVA), vinyl, or a mixture of these materials with the aforedescribed components. Furthermore, the harder particles may also be present in the form of balls within the elastomer component. In addition to this, particle crystals may also be utilized.

At room temperature, for example, the hardness of the elastomer component is in the range of between 60 and 80 Shore D and increases with decreasing temperature, preferably in accordance with a predetermined course.

Thus, the invention provides a running surface, or a coating material and a coating, for a ski to be used in cross-country or long distance skiing, under variable snow conditions. The coating may be applied as an aid in ascending, in the central region of the running surface of the ski. The coating 20 consists of a soft substance with elastic behavior and contains in addition a harder particle component. Part of these harder particles are so formed that they project from the bottom surface of the ski coating. This is accomplished, for example, by grinding the surface of the ski coating plate designed to be the bottom face in such a manner that a hairy surface is produced on the surface thus ground. The projecting particles are affixed by their roots in the elastomer component. The invention further provides a procedure for manufacturing the coating material and the ski coating and a ski for variable snow conditions on which the coating material of the invention is used.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A cross-country ski having gliding surfaces running substantially the length of a longitudinal axis thereof and having therewith a central region between said gliding surfaces extending partially along the longitudinal axis thereof and over a mid-point of the length thereof, said central region having a coating which serves as an ascending aid and comprising a soft, elastically-behaving substance having fibrous particles distributed therethrough, at least a portion of said particles projecting from the surface of said substance and thereby from said running surface, whereby gliding is effected along the gliding surfaces while gripping is effected by said particles projecting from said soft elastically-behaving substance along the central region of the ski, the gripping serving as an ascending aid when required.

2. A ski as claimed in claim 1, wherein said particles are in the form of short-clipped fibers.

3. A ski as claimed in claim 2, wherein each of said fibers has a thickness in the range of about 5 to 100 micrometers and the average length of the free portion of said fibers projecting from said running surface is in the range of about 0.1 to 2 mm.

4. A ski as claimed in claim 3, wherein each of said fibers has a thickness in a range of about 10 to 20 micrometers and the average length of the free portion of said fibers projecting from said gliding surface is in a range of about 0.5 to 1 mm.

5. A ski as claimed in claim 2, wherein the quantity of said fibers is about 2 to 100 fibers per square mm.

6. A ski as claimed in claim 5, wherein the quantity of said fibers is about 10 to 30 fibers per square mm.

7. A ski as claimed in claim 1. wherein said soft, elastically-behaving substance comprises at least one elastomer component and said particles are embedded in said at least one elastomer component.

8. A coating material and coating as claimed in claim 7, wherein said particles constitute approximately 20% by weight of said elastomer component.

9. A ski as claimed in claim 7, wherein said elastomer component is selected from the group consisting of polyurethane, a rubber mixture, a modified epoxy resin, polyvinyl chloride or equivalent elastomer, and mixtures thereof.

10. A ski as claimed in claim 1, wherein said soft, elastically-behaving substance has a hardness which substantially increases with decreasing temperature.

11. A ski as claimed in claim 10, wherein said hardness of said soft, elastically-behaving substance increases approximately 10 Shore D in the temperature interval from zero ° C. to −20° C.

12. The ski of claim 1, wherein said projecting particles constitute a hairy fiber surface.

13. The ski of claim 12, wherein said particles are randomly oriented in said elastically-behaving substance.

14. A ski having a bottom central region of a running surface thereof coated for variable snow conditions, said running surface having gliding surfaces on either side of said bottom central region, said gliding surfaces running substantially the length of a longitudinal axis thereof and said central region extending partially along the longitudinal axis thereof and over a mid-point of the length thereof, in particular a cross-country or long distance running ski, said ski comprising polyethylene or a material having a predetermined low coefficient of gliding friction coated on said gliding surfaces, and adhesive coating material coated on said bottom central region of said running surface, said adhesive coating material comprising a soft, elastically-behaving substance having fibrous particles distributed therethrough, at least a portion of said particles projecting from the surface of said substance and thereby from said running surface.

* * * * *